US005946528A

United States Patent [19]

Cho

[11] Patent Number: 5,946,528

[45] Date of Patent: Aug. 31, 1999

[54] LIQUID ELECTROPHOTOGRAPHIC PRINTER

[75] Inventor: Min-soo Cho, Incheon, Rep. of Korea

[73] Assignee: Samsung Electronics Co., Ltd., Kyungki-Do, Rep. of Korea

[21] Appl. No.: 09/100,883

[22] Filed: Jun. 22, 1998

[30] Foreign Application Priority Data

Feb. 19, 1998 [KR] Rep. of Korea ..... 98-5149

[51] Int. Cl.[6] ..... G03G 21/20

[52] U.S. Cl. ..... 399/93; 399/98; 399/237

[58] Field of Search ..... 399/93, 98, 119, 399/237, 249, 250, 251

[56] References Cited

U.S. PATENT DOCUMENTS

| | | | |
|---|---|---|---|
| 4,760,423 | 7/1988 | Holtje et al. | 399/250 |
| 5,047,798 | 9/1991 | Yamamoto et al. | 399/93 |
| 5,325,159 | 6/1994 | Day | 399/91 |
| 5,689,766 | 11/1997 | Hollar et al. | 399/92 |

FOREIGN PATENT DOCUMENTS

| | | |
|---|---|---|
| 56-96447 | 12/1954 | Japan . |
| 8-190276 | 7/1996 | Japan . |

*Primary Examiner*—Richard Moses
*Assistant Examiner*—William A. Noe
*Attorney, Agent, or Firm*—Sughrue, Mion, Zinn, Macpeak & Seas, PLLC

[57] ABSTRACT

A liquid electrophotographic printer includes a printer body. An engine unit is installed in the printer body and includes a photoreceptor belt, a laser scanner for forming a latent electrostatic image on the photoreceptor belt, a development device for developing the latent electrostatic image by supplying a developer liquid which is a mixture of a liquid carrier and a toner, a transfer roller for transferring the developed image to a print paper, a fixation roller for pressing the print paper against the transfer roller, and a drying unit for evaporating the liquid carrier remaining on the photoreceptor belt. A closed cell encompasses the engine unit. An exhaust fan exhausts the air inside the closed cell. A filter removes the gaseous carrier from the exhausted air.

4 Claims, 2 Drawing Sheets

LIQUID ELECTROPHOTOGRAPHIC PRINTER

BACKGROUND OF THE INVENTION

1. Field of the Invention

The present invention relates to a liquid electrophotographic printer, and more particularly, to an improved liquid electrophotographic printer which suppresses harmful matter generated in a printer body from being effused to the outside.

2. Description of the Related Art

A liquid electrophotographic printer, such as the color laser printer shown in FIG. 1, includes a paper feeding tray 8 for supplying and feeding print paper into a body 10 of the printer, and a paper discharging tray 9 for receiving the print paper discharged from the body 10. A photoreceptor belt 1 circulates around a plurality of guide rollers 2 which are mounted for rotation within the body 10. A plurality of laser scanners 4 form a latent electrostatic image on the photoreceptor belt 1, and a plurality of development devices 3 develop the latent electrostatic image. A transfer roller 5 transfers the developed image to the print paper fed between the transfer roller 5 and a fixation roller 6.

The development devices 3 supply a developer liquid having a liquid carrier mixed with a toner to the photoreceptor belt 1 to develop the electrostatic image. Accordingly, liquid carrier and toner are applied to the surface of the photoreceptor belt. A drying unit 7 evaporates the liquid carrier remaining on the photoreceptor belt.

The carrier, placed in a gaseous state by the drying unit 7, may then effuse into the environment through a paper path of the paper feeding tray 8 and paper discharging tray 9. Unfortunately, the carrier is hazardous. Therefore, the distribution thereof should be strictly controlled.

SUMMARY OF THE INVENTION

An objective of the present invention is to provide an improved liquid electrophotographic printer that prevents the harmful matter generated in a printer body from being effused to the outside environment.

The present liquid electrophotographic printer comprises: a printer body; an engine unit installed in the printer body and having a photoreceptor belt, a laser scanner for forming a latent electrostatic image on the photoreceptor belt, a development device for developing the latent electrostatic image by supplying a developer liquid which is a mixture of a liquid carrier and a toner, a transfer roller for transferring the developed image to a print paper, a fixation roller for pressing the print paper against the transfer roller, and a drying unit for evaporating the liquid carrier remaining on the photoreceptor belt; a closed cell encompassing the engine unit to accommodate the gaseous carrier generated by the drying unit; an exhaust fan for exhausting the air inside the closed cell; and a filter for removing the gaseous carrier from the air exhausted by the exhaust fan.

The above and other features of the invention including various and novel details of construction and combination of parts will now be more particularly described with reference to the accompanying drawings and pointed out in the claims. It will be understood that the particular electrophotographic printer embodying the invention is shown by way of illustration only and not as a limitation of the invention. The principles and features of this invention may be employed in varied and numerous embodiments without departing from the scope of the invention.

DESCRIPTION OF THE PREFERRED EMBODIMENTS

Figure 1:
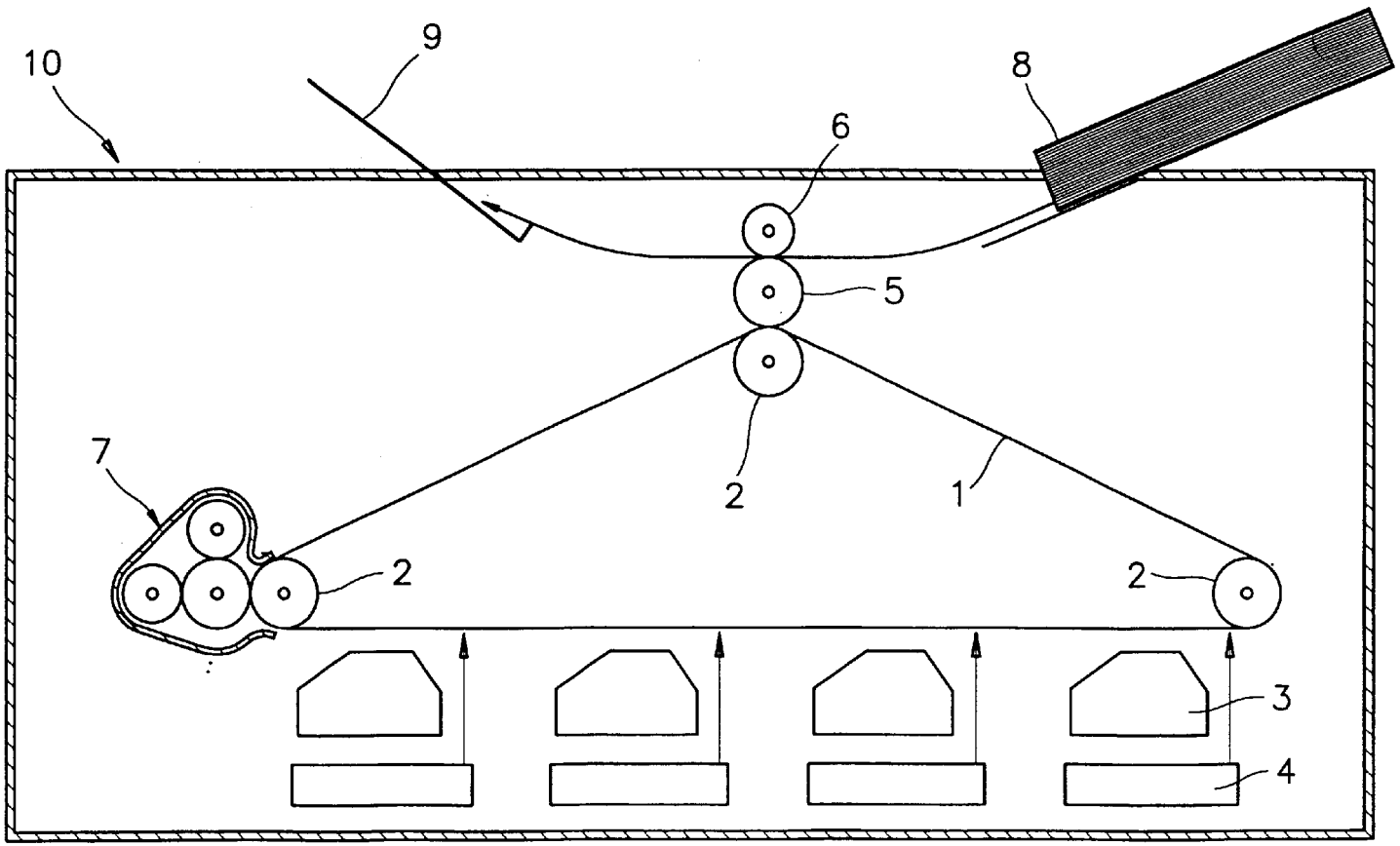
FIG. 1(PRIOR ART)
FIG. 1 is a schematic illustration of a conventional liquid electrophotographic printer.
Figure 2:
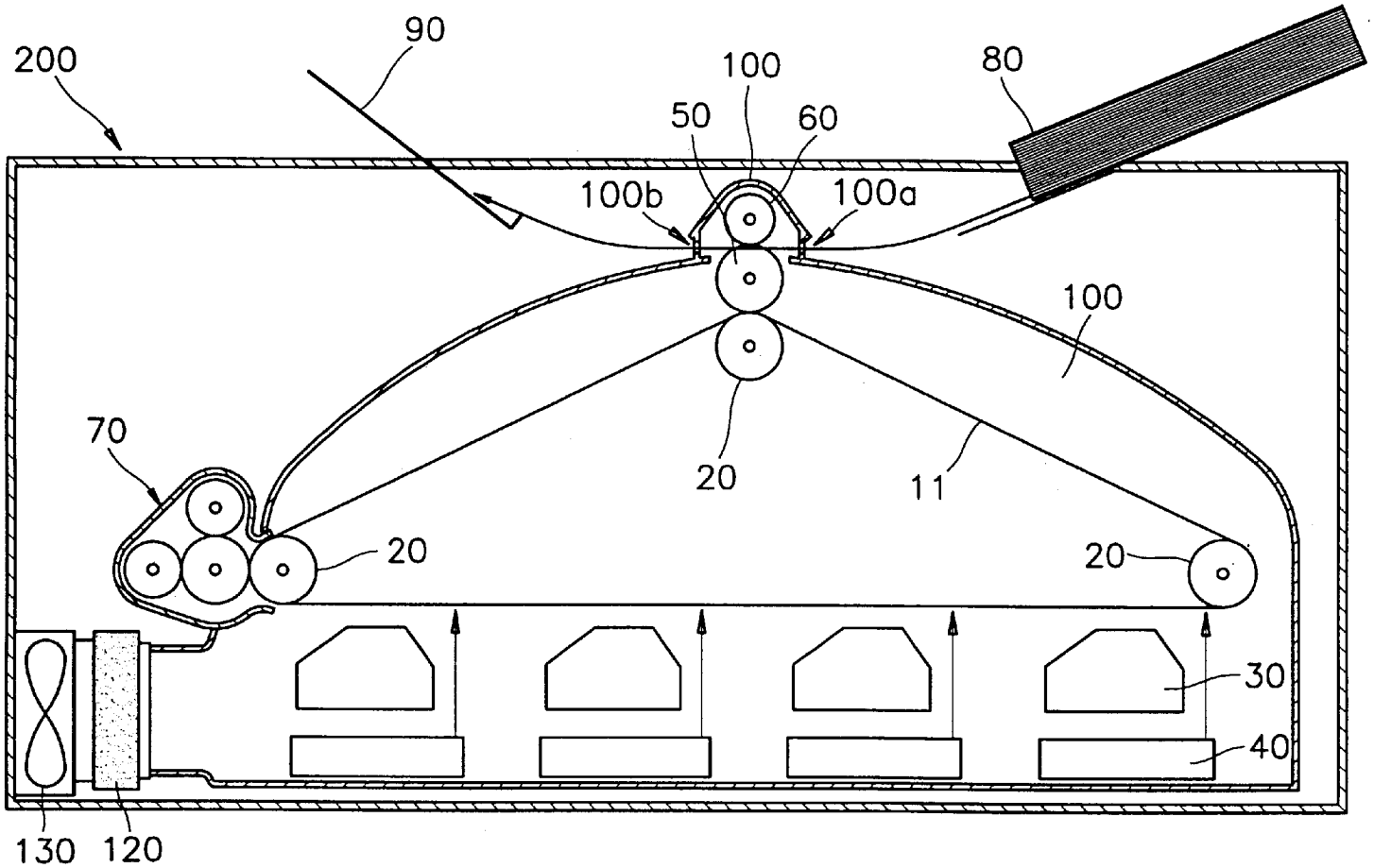
FIG. 2 is a schematic illustration of a liquid electrophotographic printer according to an embodiment of the present invention.

FIG. 2 shows the present liquid electrophotographic printer which prevents harmful matter from effusing into the environment. A paper feeding tray 80 and a paper discharging tray 90 are provided in a printer body 200. An engine unit, for printing a desired image onto a print paper supplied from the paper feeding tray 80, is installed within the printer body 200.

The engine unit includes a photoreceptor belt 11 supported by a plurality of guide rollers 20 which are mounted for rotation within the printer body 200, a plurality of laser scanners 40 for forming a latent electrostatic image on the photoreceptor belt 11, a plurality of development devices 30 for developing the latent electrostatic image, and a transfer roller 50 for transferring the developed image to the print paper fed between the transfer roller 50 and a fixation roller 60. A drying unit 70 is provided for drying a liquid carrier remaining on the photoreceptor belt 11.

According to the present invention, the engine unit is surrounded by a closed cell 100. In other words, the closed cell 100 encompasses the photoreceptor belt 11, the development devices 30, the transfer roller 50, the fixation roller 60, and the drying unit 70. Thus, the gas carrier generated from the drying unit 70 is contained within the closed cell 100. An inlet 100*a* and an outlet 100*b* are formed in the closed cell 100 so as to receive and discharge the print paper.

An exhaust fan 130 is installed in the closed cell 100 to exhaust the air inside the closed cell 100. When operated, the exhaust fan 130 maintains a pressure inside the closed cell 100 lower than that of the outside environment. Thus, external air is induced into the closed cell 100 through the inlet 100*a*, the outlet 100*b* or other clearances, thereby preventing the gas carrier from escaping the closed cell 100 via these clearances.

A filter 120 is provided in the flow passage of the contaminated air exhausted by the exhaust fan 130. The gaseous carrier is removed from the air exhausted by the exhaust fan 130 as it passes through the filter 120. Thus, only clean air is exhausted from the closed cell 100.

As described above, a closed cell encompasses an engine unit to prevent harmful matter such as a gas carrier generated in the engine unit from being effused to the outside environment.

What is claimed is:

1. A liquid electrophotographic printer comprising:

a printer body;

an engine unit installed in the printer body and having a photoreceptor belt, a laser scanner for forming a latent electrostatic image on the photoreceptor belt, a development device for developing the latent electrostatic image by supplying a developer liquid which is a mixture of a liquid carrier and a toner to the photoreceptor belt, a transfer roller for transferring the developed image to a print paper, a fixation roller for pressing the print paper against the transfer roller, and a drying unit for evaporating the liquid carrier remaining on the photoreceptor belt, thereby generating a gaseous carrier;

a closed cell encompassing the engine unit to accommodate the gaseous carrier generated by the drying unit;

an exhaust fan for exhausting the air inside the closed cell, such that an air pressure within the closed cell is less than the ambient atmospheric pressure; and a filter placed in a flow passage of the air exhausted by the exhaust fan for filtering the gaseous carrier from the exhausted air.

2. The liquid electrophotographic printer according to claim 1, wherein the closed cell further includes:

an inlet through which the print paper is fed; and an outlet through which the print paper is discharged.

3. A liquid electrophotographic printer comprising:

a printer body;

an engine unit installed in the printer body, said engine unit (1) for supplying a developer liquid which is a mixture of a liquid carrier and a toner to an image carrier, and (2) for evaporating the liquid carrier remaining on the image carrier, thereby generating a gaseous carrier;

a closed cell encompassing the engine unit to accommodate the gaseous carrier;

an exhaust fan for exhausting the air inside the closed cell, such that an air pressure within the closed cell is less than the ambient atmospheric pressure; and a filter placed in a flow passage of the air exhausted by the exhaust fan for removing the gaseous carrier from the exhausted air.

4. The liquid electrophotographic printer according to claim 3, wherein the closed cell further includes:

an inlet through which the print paper is fed; and an outlet through which the print paper is discharged.

* * * * *